US006464001B1

(12) United States Patent
Braithwaite et al.

(10) Patent No.: US 6,464,001 B1
(45) **Date of Patent: *Oct. 15, 2002**

(54) MULTILATERAL WELLBORE SYSTEM

(75) Inventors: Stephen Richard Braithwaite, St. George (CA); Wilhelmus Hubertus Paulus Maria Heijnen, Nienhagen (DE); Robert Nicholas Worrall, Rijswijk (NL)

(73) Assignee: Shell Oil Company, Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/635,058

(22) Filed: Aug. 9, 2000

(30) Foreign Application Priority Data

Aug. 9, 1999 (EP) ..... 99306278

(51) Int. Cl.[7] ..... E21B 43/14
(52) U.S. Cl. ..... 166/117.5; 166/50
(58) Field of Search ..... 166/313, 50, 117.5, 166/117.6, 242.1, 242.3, 381, 382

(56) References Cited

U.S. PATENT DOCUMENTS

| | | | | |
|---|---|---|---|---|
| 5,318,122 A | | 6/1994 | Murray et al. | |
| 5,361,843 A | | 11/1994 | Shy et al. | |
| 5,388,648 A | | 2/1995 | Jordan, Jr. | |
| 5,390,742 A | | 2/1995 | Dines et al. | |
| 5,462,120 A | | 10/1995 | Gondouin | |
| 5,680,901 A | | 10/1997 | Gardes | |
| 5,715,891 A | * | 2/1998 | Graham | 166/313 |
| 5,829,520 A | | 11/1998 | Johnson | |
| 5,875,847 A | | 3/1999 | Forsyth | |
| 5,944,107 A | | 8/1999 | Ohmer | |
| 5,944,108 A | * | 8/1999 | Baugh et al. | 166/313 |
| 5,979,560 A | | 11/1999 | Nobileau | |
| 6,053,254 A | * | 4/2000 | Gano | 166/384 |
| 6,056,059 A | | 5/2000 | Ohmer | |
| 6,065,543 A | * | 5/2000 | Gano et al. | 166/378 |
| 6,079,495 A | | 6/2000 | Ohmer | |
| 6,158,513 A | * | 12/2000 | Nistor et al. | 166/313 |
| 6,189,616 B1 | | 2/2001 | Gano et al. | |

FOREIGN PATENT DOCUMENTS

| | | |
|---|---|---|
| EP | 0786578 | 7/1997 |
| EP | 0823534 B1 | 11/1999 |
| EP | 0795679 A3 | 2/2000 |
| GB | 2320735 | 7/1998 |
| GB | 2346165 | 8/2000 |
| GB | 2357099 | 6/2001 |
| RU | 2079633 | 5/1997 |
| WO | 9403701 | 2/1994 |
| WO | 96/26350 | 8/1996 |
| WO | 97/06345 | 2/1997 |
| WO | 97/49894 | 12/1997 |
| WO | 98/09053 | 3/1998 |
| WO | 99/04135 | 1/1999 |
| WO | 99/13195 | 3/1999 |
| WO | 00/26501 | 5/2000 |
| WO | 00/31375 | 6/2000 |
| WO | 00/46479 | 8/2000 |
| WO | 00/46484 | 8/2000 |
| WO | 00/50733 | 8/2000 |

* cited by examiner

*Primary Examiner*—Frank S. Tsay

(57) ABSTRACT

A wellbore system is provided, the wellbore including a main wellbore extending into an earth formation, a branch wellbore extending from a selected location of the main wellbore into the earth formation and a casing arranged in the main wellbore. A branching device is arranged in the casing and connected to a conduit extending through the casing to a wellbore facility at surface, the branching device having a main bore in fluid communication with the wellbore facility via the conduit, and a branch bore providing fluid communication between the main bore and the branch wellbore via a window opening provided in the casing. A seal is provided between said body and the inner surface of the casing so as to prevent fluid communication between the window opening and the interior of the casing.

11 Claims, 2 Drawing Sheets

MULTILATERAL WELLBORE SYSTEM

FIELD OF THE INVENTION

The present invention relates to a multilateral wellbore system.

BACKGROUND TO THE INVENTION

The multilateral wellbore system of the present invention comprises a main wellbore extending into an earth formation, a branch wellbore extending from a selected location of the main wellbore into the earth formation and a casing arranged in the main wellbore, such wellbore system being generally referred to as multilateral system. The branch wellbore can be created together with the main wellbore in a single drilling procedure, or can be created at a later stage after the main wellbore has been in operation for a period of time.

In case the branch wellbore is created at such later stage it is generally undesirable that drilling fluid and/or drill cuttings enter the interior of the casing of the main wellbore. Furthermore it is generally undesirable that hydrocarbon fluid flows from the earth formation into the casing at the junction of the main wellbore and the branch wellbore.

It is an object of the invention to provide an adequate multilateral wellbore system which prevents undesirable inflow of drilling fluid into the casing during drilling of the branch wellbore, and which furthermore prevents undesirable inflow of hydrocarbon fluid into the casing at the junction of the main wellbore and the branch wellbore.

SUMMARY OF THE INVENTION

In accordance with the invention there is provided a wellbore system comprising a main wellbore extending into an earth formation, a branch wellbore extending from a selected location of the main wellbore into the earth formation, a casing arranged in the main wellbore, a branching device arranged in the casing and connected to a conduit extending through the casing to a wellbore facility at surface, the branching device having a main bore in fluid communication with the wellbore facility via the conduit, and a branch bore providing fluid communication between the main bore and the branch wellbore via a window opening provided in the casing, wherein a seal is provided between said body and the inner surface of the casing so as to prevent fluid communication between the window opening and the interior of the casing.

The window opening is in fluid communication with the branch bore of the branching device and with the branch wellbore. As the seal prevents fluid communication between the window opening and the interior of the casing, drilling fluid present in the branch bore and the branch wellbore during drilling of the latter is prevented from entering the interior of the casing. The seal also prevents any hydrocarbon fluid present in the branch bore and the branch wellbore during hydrocarbon fluid production from entering the interior of the casing.

Suitable the main wellbore is an existing wellbore and the branch wellbore is drilled a period of time after the main wellbore has become operational to produce hydrocarbon fluid.

The main wellbore generally extends from surface through an overburden layer and a cap rock layer into a hydrocarbon fluid reservoir of the earth formation. The branch wellbore can suitably be drilled into a hydrocarbon fluid containing zone of the earth formation at a relatively large distance from the main wellbore if the branching device is located relatively high in the main wellbore, for example in the overburden layer.

Suitably the main wellbore is an existing wellbore and the branch wellbore is drilled a period of time after the main wellbore has become operational to produce hydrocarbon fluid.

DESCRIPTION OF A PREFERRED EMBODIMENT

Figure 1:
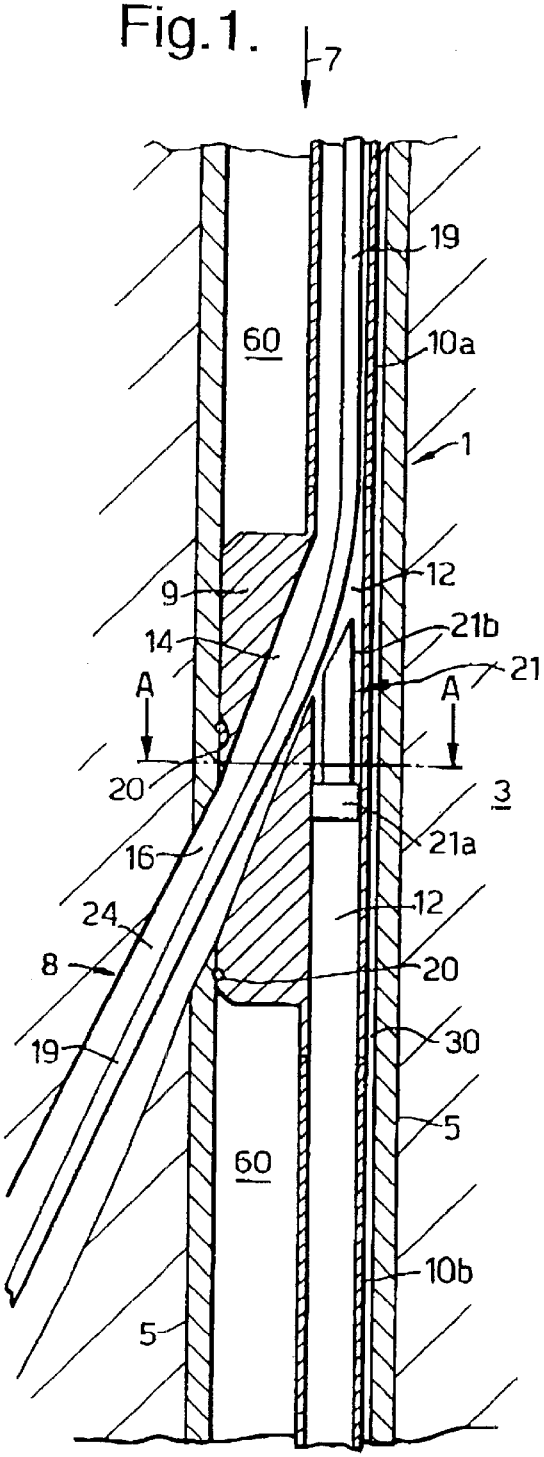
FIG. 1 schematically shows a longitudinal cross-section of an embodiment of the wellbore system according to the invention during drilling.
Figure 2:
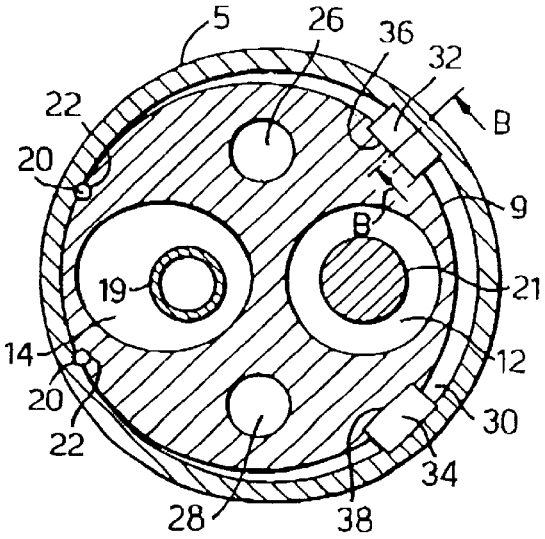
FIG. 2 schematically shows cross-section A—A of FIG. 1.

Referring to FIGS. 1 and 2, there is shown a wellbore system comprising a main wellbore 1 formed in an earth formation 3, the main wellbore being provided with a casing 5 which can be a conventional casing or an expandable casing. The main wellbore extends from the earth surface (not shown) to a hydrocarbon fluid reservoir (not shown) of the earth formation, the direction from surface to the reservoir being indicated by arrow 7.

A branching device in the form of mandrel 9 is arranged in the wellbore 1, the mandrel 9 being connected to an upper tubular conduit 10*a* extending through the casing 5 to a drilling rig or coiled tubing rig at surface (not shown), and to a lower tubular conduit 10*b* extending through the casing 5 to a hydrocarbon fluid inlet (not shown) located in a lower part of the main wellbore 1. The mandrel 9 has a main bore 12 in fluid communication with the drilling rig via the upper tubular conduit 10 and in fluid communication with the hydrocarbon fluid inlet via the lower conduit 10*b*. The mandrel 9 further has a branch bore 14 extending from the main bore 12 to a window opening 16 formed in the casing 5. A branch wellbore 18 extends from the window opening 16 into the earth formation 3, the branch wellbore 18 being aligned with the branch bore 14 of the mandrel 9. A drill string 19 extends from the drilling rig via the conduit 10, the main bore 12, the branch bore 14 and the window opening 16 into the branch wellbore 18. The drill string is at its lower end provided with a drill bit (not shown). A packer/whipstock assembly 21 including a packer 21*a* and a whipstock 21*b* is arranged in the main bore 12 below the junction with the branch bore 14. The packer 21*a* seals the lower part of the main bore 12 and supports the whipstock 21*b* at a position so as to guide the drill string from the main bore 12 into the branch bore 14.

An oval shaped endless seal 20 is arranged between the mandrel 9 and the inner surface of the casing 5 and extends around the window opening 16 of the casing and being fixed in an oval shaped groove 22 provided at the outer surface of the mandrel 9. The seal 20 is made of deformable metal material or elastomeric material, or a combination thereof.

A body of drilling fluid 24 is present in the space formed between the drill string 19 on one hand and the conduit 10*a*, the main bore 12, the branch bore 14, the window opening 16 and the branch wellbore 18 on the other hand.

The mandrel is provided with secondary bores 26, 28. A clearance 30 is present between the outer surface of the mandrel 9 and the inner surface of the casing 5. The secondary bores 26, 28 and the clearance 30 each provide fluid communication between the interior of the casing 5 below and above the mandrel 9.

Figure 3:
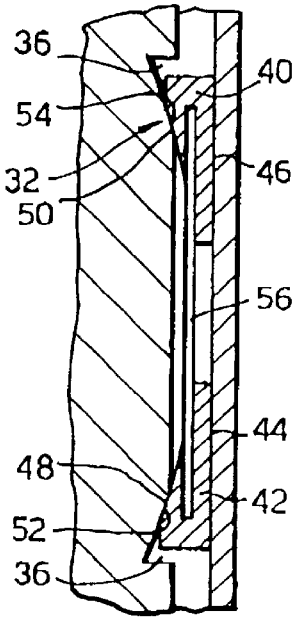
FIG. 3 schematically shows cross-section B—B of FIG. 2.

Referring further to FIG. 3 the mandrel 9 and the seal 20 are forced against the inner surface of the casing 5 at the side of the window opening 16 by the action of two activating members 32, 34. Each activating member 32, 34 is arranged in a recess 36, 38 of the mandrel 9 at the outer surface thereof and includes a pair of wedge shaped elements in the form of slips 40, 42 movable between an extended position and a retracted position in which the slips 40, 42 are at shorter mutual distance than in the extended position. Each slip 40, 42 has a first contact surface 44, 46 aligned with and in contact with the inner surface of the casing 5, and a second contact surface 48, 50 aligned with and in contact with an inclined surface 52, 54 of the mandrel. The first contact surface 44, 46 is provided with hardened metal teeth (not shown) to enhance the holding power of the first surface against the casing. The inclination direction of the inclined surfaces 50, 52 is such that the activating member 32, 34 radially expands upon movement of the slips 40, 42 from the expanded position to the retracted position. A memory metal element 56 interconnects the slips 40, 42, which element 56 moves the slips 40, 42 from the extended position to the retracted position upon reaching the transition temperature.

Figure 4:
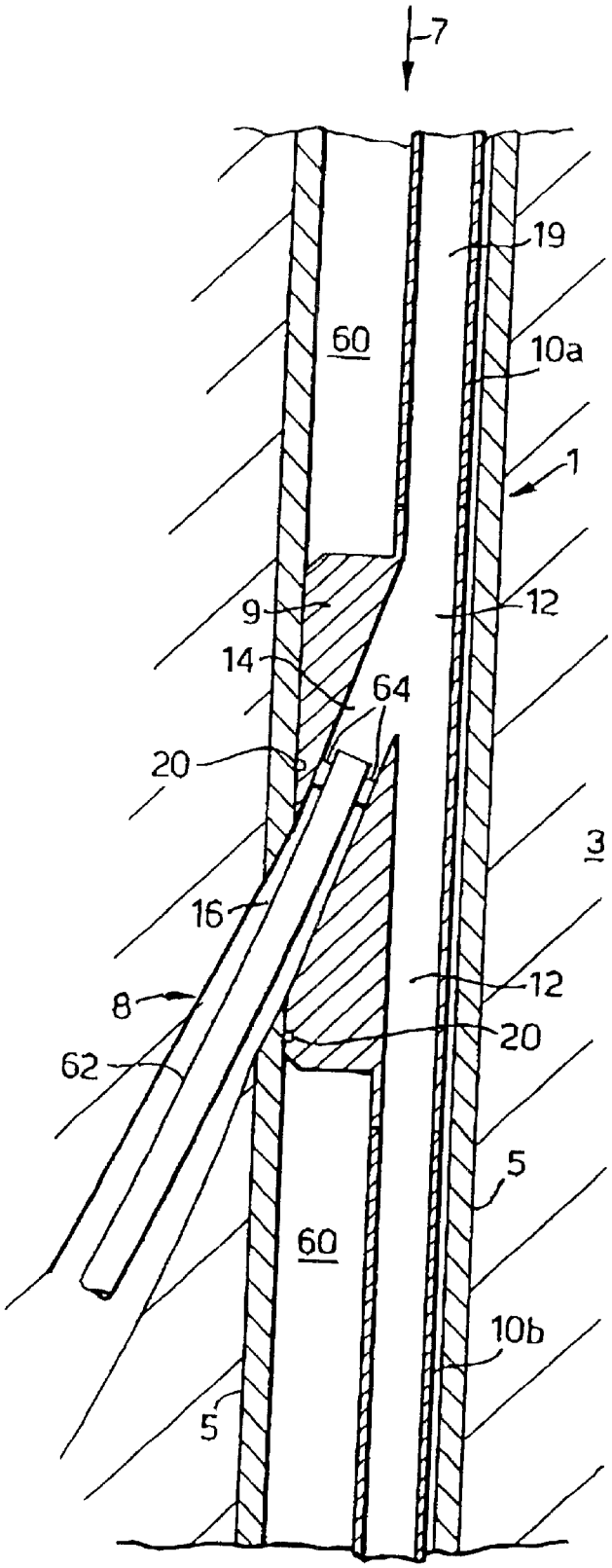
FIG. 4 schematically shows the longitudinal crosssection of the embodiment of FIG. 1 during hydrocarbon fluid production.

Referring to FIG. 4, there is shown the wellbore system of FIGS. 1–3 whereby the drill string 19 and the whipstock/packer assembly 21 have been removed from the wellbore system. A tubular liner 62 extends from the branch bore 14 via the window opening 16 into the branch wellbore 18. The upper end part of the liner 62 extends into the branch bore 14 and is provided with an annular sealing element 64 which is operable between a radially retracted mode wherein a clearance is present between the sealing element 64 and the branch bore 14, and a radially expanded mode wherein the liner is sealed to the branch bore 14. The sealing element 64 includes a memory metal activator (not shown) to move the sealing element from the radially retracted mode to the radially expanded mode. The drilling rig at surface has been replaced by a hydrocarbon fluid production facility (not shown).

During normal operation the main wellbore 1 is an existing wellbore and the branch wellbore 18 is to be drilled from the existing wellbore. Each memory metal element 56 is below its transition temperature so that the activating members 32, 34 are in their expanded position. The mandrel 9 is lowered through the casing 5 to the position where the branch wellbore is to be initiated, whereby during lowering the mandrel is centralised in the casing 5 by suitable centralisers (not shown) to protect the seal 20 from contact with the casing. When the mandrel 9 is located at the desired position, a heating device (not shown) is lowered via the upper tubular conduit 10*a* into the main bore 12 where the heating device is operated so as to heat the memory metal elements 56. Upon reaching their transition temperature, the memory metal elements 56 retract and thereby move the slips 40, 42 from the expanded position to the retracted position. As a result the slips 40, 42 become firmly pressed against one side of the inner surface of the casing 5 and the seal 20 becomes firmly pressed against the opposite side of the inner surface of the casing 5. The mandrel thereby becomes locked in the casing, and the seal 20 deforms so as to form a metal-to-metal seal against the casing.

The packer/whipstock assembly 21 is then lowered via the upper conduit 10*a* into the main bore 12 and fixedly positioned in the main bore 12 by activating packer 21*a*. The drill string 19 is then lowered through the upper conduit 10*a* into the main bore 12. Upon contacting the whipstock 21*b*, the drill string 19 is guided by the whipstock 21*b* into the branch bore 14 until the drill bit contacts the inner surface of the casing 5. The drill string is then rotated and thereby mills the window opening 16 in the casing 5 and subsequently drills the branch wellbore 18. Drilling fluid is circulated in conventional manner through the drills string 19 to the drill bit and from there through the branch wellbore 18, the branch bore 14, the main bore 12 and the upper conduit 10*a* to surface. The seal 20 prevents drilling fluid and drill cuttings from entering the space 60 formed between the casing 5 on one hand and the mandrel 9, the upper conduit 10*a* and the lower conduit 10*b* on the other hand. Drilling is continued until branch wellbore 18 reaches a hydrocarbon fluid containing zone (not shown) of the earth formation. During drilling the space 60 is filled with water, brine or air.

After drilling is completed, the drill string 19 is removed from the wellbore system and the liner 62 is lowered via the upper conduit 10*a* into the branch bore 14 and from there into the branch wellbore 18. A heating device (not shown) is lowered into the upper end part of the liner 62 and operated thereby raising the temperature of the memory metal activator to above its transition temperature and inducing the sealing element 64 to radially expand and thereby seal the liner 62 to the inner surface of the branch bore 14. The liner 62 is suspended in this position by a conventional liner hanger (not shown).

Hydrocarbon fluid is then produced from the earth formation, whereby the hydrocarbon fluid flows in a first stream via the conduit 10*b*, main bore 12 and conduit 10*a* to the hydrocarbon fluid production facility, and in a second stream from the hydrocarbon fluid containing zone into the liner 62 and from there via the main bore 12 into the upper conduit 10*a* where the first stream and the second stream merge. During hydrocarbon fluid production, the seal 20 prevents outflow of hydrocarbon fluid from the branch bore 14 into the space 60 in case of failure of the sealing element 64. Furthermore, the seal 20 furthermore prevents inflow of hydrocarbon fluid from the earth formation 3 via the window opening 16 into the space 60.

Suitably the casing 5 is provided with an inlet (not shown) in fluid communication with a hydrocarbon fluid reservoir of the earth formation 3, whereby during drilling and/or during hydrocarbon fluid production hydrocarbon fluid is produced from the reservoir via the inlet into the casing 5 and from there via the space 60, the secondary bores 26, 28 and the clearance 30 to surface.

It will be understood that instead of a single branch wellbore the wellbore system can comprise a plurality of branch wellbores connected to the main wellbore at different depth, each branch wellbore being created and operated in the manner described above.

Instead of a single endless seal being arranged between the mandrel and the inner surface of the casing, the wellbore system can include a plurality of such seals arranged at mutually different distances from the window opening.

Instead of the drill bit being rotated by rotation of the drill string at surface, the drill bit can be rotated by a downhole motor incorporated in the drill string.

Instead of drilling the window opening after the mandrel has been installed in the casing, the window opening can be milled and the branch wellbore be drilled before the mandrel is installed. To align the mandrel accurately with the window opening the branch bore can be provided with a spring loaded drag block suspended in the branch bore by a suspension system such as a groove and dog. The drag block drags against the casing while running the mandrel into the casing. When the mandrel arrives at the depth of the window opening the mandrel is manipulated until the drag block enters the window opening thereby providing positive location of the mandrel relative to the window opening. After the slips have been activated the spring loaded drag block is removed from the wellbore, e.g. using a fishing tool on drill pipe or coiled tubing.

One or more of the secondary bores may be used as a passage for electric cables or hydraulic conduits for power transmission or communication.

We claim:

1. A wellbore system comprising:

a main wellbore extending into an earth formation;

a branch wellbore extending from a selected location of the main wellbore into the earth formation;

a casing arranged in the main wellbore;

a branching device arranged in the casing and connected to a conduit extending through the casing to a wellbore facility at surface, the branching device having a main bore in fluid communication with the wellbore facility via the conduit; and a branch bore providing fluid communication between the main bore and the branch wellbore via a window opening provided in the casing, wherein a seal is provided between said branching device and the inner surface of the casing so as to prevent fluid communication between the window opening and the interior of the casing, wherein the seal extends around the window opening.

2. The wellbore system of claim 1, wherein the seal extends around the window opening.

3. The wellbore system of claim 2, wherein the seal is activated by at least one activating member selectively exerting a force to the branching device in the direction of the window opening.

4. The wellbore system of claim 3, wherein each activating member comprises a pair of wedge shaped elements movable between an extended position and a retracted position in which the wedge shaped elements are at shorter mutual distance than in the extended position, and wherein in the extended position the activating member allows movement of the branching device through the casing and in the retracted position exerts said force to the branching device.

5. The wellbore system of claim 4, wherein the activating member comprises a memory metal member interconnecting the wedge shaped elements, which memory metal element is arranged to move the wedge shaped elements from the extended position to the retracted position upon reaching the transition temperature of the memory metal element.

6. The wellbore system of claim 1 wherein the wellbore facility is a drilling facility and wherein a drill string extends via the conduit, the main bore and the branch bore into the branch wellbore.

7. The wellbore system of claim 1 wherein the wellbore facility is a hydrocarbon fluid production facility and wherein a branch casing extends from the branch bore into the branch wellbore.

8. The wellbore system of claim 7, wherein the branch casing extends into the branch bore, and wherein an annular sealing element is arranged between the branch casing and the branch wellbore.

9. The wellbore system of claim 1 wherein the conduit is a primary conduit and the system further comprises a secondary conduit extending through the casing and providing fluid communication between the main bore and a hydrocarbon fluid reservoir of the earth formation.

10. The wellbore system of claim 1 further comprising a passage for hydrocarbon fluid flowing through the casing from the interior of the casing below the branching device to the interior of the casing above the branching device.

11. The wellbore system of claim 10, wherein the passage is formed by a clearance between the branching device and the casing.

* * * * *